United States Patent [19]

Maihart

[11] 4,238,858

[45] Dec. 16, 1980

[54] ABLUTION OR TOILET COMPARTMENT

[76] Inventor: Hans H. Maihart, Brühlerstrasse 79/2/2, 2340 Mödling, Austria

[21] Appl. No.: 31,144

[22] Filed: Apr. 18, 1979

[30] Foreign Application Priority Data

Apr. 20, 1978 [AT] Austria ..... 2802/78

[51] Int. Cl.[3] ..... A47K 4/00

[52] U.S. Cl. ..... 4/546; 52/34; 52/79.1; 4/553; 4/589; 4/663; 4/664

[58] Field of Search ..... 4/146, 2, 3, 4, 5

[56] References Cited

U.S. PATENT DOCUMENTS

| | | | |
|---|---|---|---|
| 2,087,121 | 7/1937 | Samelow | 4/2 |
| 2,220,482 | 11/1940 | Fuller | 4/2 X |
| 2,486,371 | 10/1949 | Mankki | 4/2 |
| 3,015,110 | 1/1962 | Treand | 4/2 |
| 3,533,200 | 10/1970 | Zoebelein | 4/146 |
| 3,905,048 | 9/1975 | Moller | 4/146 |

*Primary Examiner*—Henry K. Artis
*Attorney, Agent, or Firm*—Spencer & Kaye

[57] ABSTRACT

An ablution compartment includes a base tray and a plurality of booth elements supported on the base tray. The booth elements comprise a plurality of first wall elements and a plurality of second wall elements. Each first wall element is of an angled configuration having a single, substantially planar wall limb and a single, substantially planar ceiling limb arranged at right angles to the wall limb. Each second wall element has a wall surface and connects two first wall elements to one another. The wall limbs of the first wall elements and the wall surfaces of the second wall elements together form an all-around enclosure above the base tray.

7 Claims, 8 Drawing Figures

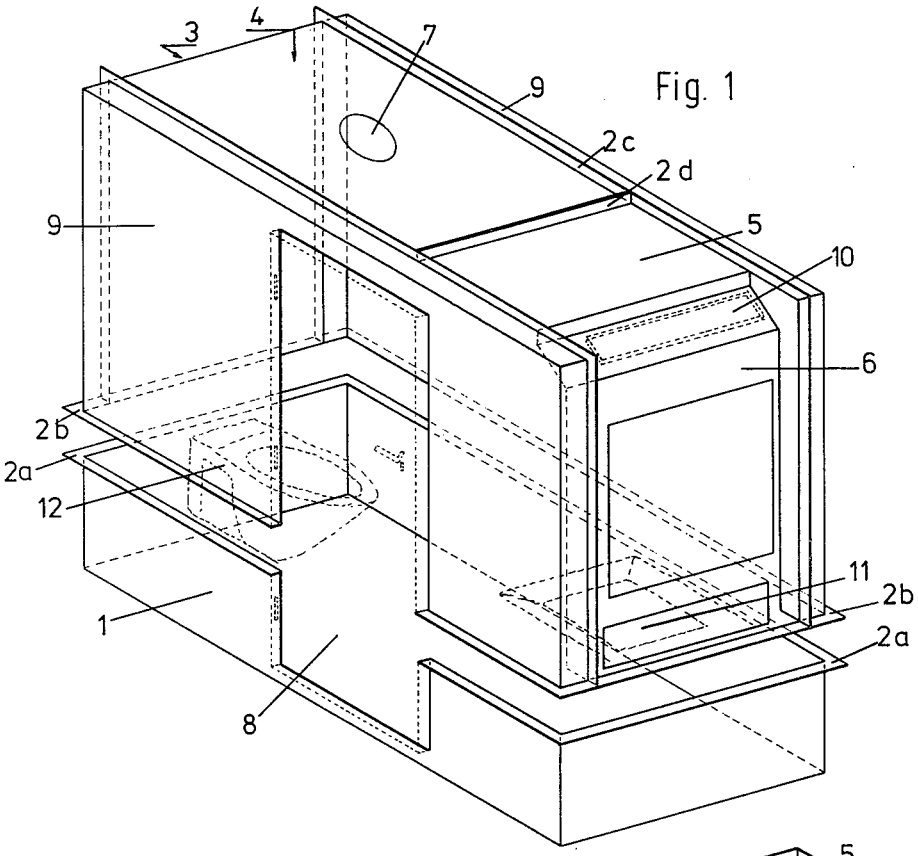
Fig. 1
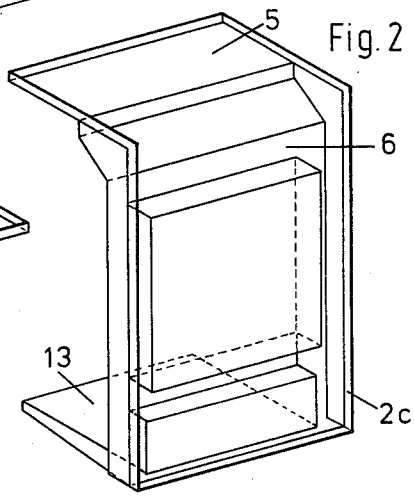
Fig. 2
Fig. 3
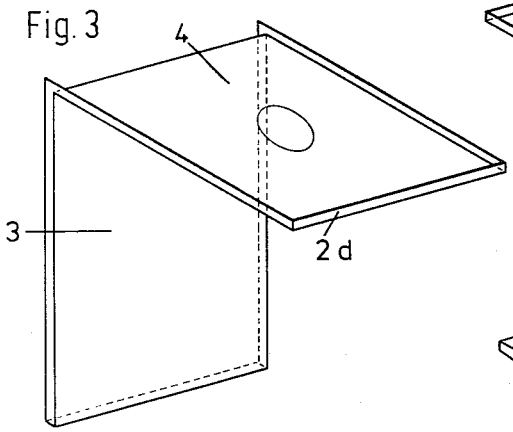

ABLUTION OR TOILET COMPARTMENT

BACKGROUND OF THE INVENTION

The previously known bath arrangements or cupboard baths, which can be installed in an existing living room during the life of a building, consist generally of a cabinet of suitable ground plane shape which can be installed on the floor of a living room, and four walls, a ceiling, and a door. In these known cupboard baths, the cupboard is formed in one piece and can be mounted as a whole on the cabinet containing a bath tub. Since the bath tub takes up the entire plan area of the cabinet, the person bathing must, before and after the bath, stay outside the cupboard, i.e. in the living room, and there undress and dress and perform all the necessary body treatment actions. Such a cupboard bath thus reserves the living room for bathing purposes. Apart from this fundamental disadvantage, the bulky cupboard has dimensions greater than the clear width of ordinary door frames, and this causes local problems in delivering the cupboard bath into the room.

There are however also other bath booths known which can be installed in existing living rooms, which likewise contain a wash basin or a bath tub, and consist only of a compact construction manufactured in a predetermined format without the possibility of variations.

SUMMARY OF THE INVENTION

In contrast to this known state of the art, the idea which underlies the invention is to provide a walk-in ablution or toilet compartment from a few standardised constructional elements which are light and can be transported into living rooms independently of the width of door openings, and can there be assembled together, and which can be provided with all desired necessary functions, e.g. for washing, for bathing, and for use of toilet, while for each of the individual functions a separate space can if desired be provided within the compartment.

The objects of the invention are preferably realised according to the invention in that, on a foundation of a walk-in base tray provided in various ground plan sizes according to a modular system of dimensions, with peripheral flanges directed outwards, a number of booth wall constructional elements are erected, which are made according to the same modular dimensional system, and which, by means of flanges directed outwards from their wall edges, can be assembled to one another and to the flange of the base tray into a tightly enclosed walk-in ablution or toilet compartment, while the base tray as well as the booth wall elements are provided with openings for the supply of water under pressure, drainage of waste water, and for sewage removal, to which pipes can be connected.

By the modular dimensional system, the great advantage is obtained that each of the wall building elements can be employed with different sizes of base tray, that is to say can be used in many designs of compartments. In this way, despite great possibilities of variation in the ablution or toilet compartments according to the invention, success is obtained with a relatively small stock of individual components. To this is added that the small number of building elements necessitates a correspondingly small number of tools for their manufacture (e.g. by moulding), by which means the capital costs are reduced to a minimum amount.

In a further development of the invention, the booth walling consists in part of two angle elements each having a wall limb and a ceiling limb arranged at right angles to the wall limb, and in part of side panels or box elements which screen the compartment of the booth at the sides, while the individual constructional elements can be connected tightly and firmly to one another and to the base tray by flanges directed outwards or a similar suitable connecting means.

However, also according to the invention, onto the walk-in base tray, a bath tub can be laterally added, while the walk-in base tray is separated by an elastically yielding dividing wall from the bath tub, and this dividing wall, for formation of a foot recess, is curved over at the top by the wall of the bath tub, in the direction towards the walk-in base tray, and the wall components of the booth wall are suited to the ground plan dimensions thus produced, corresponding to the modular dimensional system.

Finally, it is also possible according to the invention to add on, on each side of the walk-in base tray, one or more base trays with the possibility of access, which each belong to a toilet booth formed by booth walls with separate fittings, and are only accessible through a door communicating with the compartment of the walk-in base tray.

BRIEF DESCRIPTION OF THE DRAWINGS

In the accompanying drawings a plurality of examples of ablution or toilet compartments embodying the invention are shown schematically. In these drawings:

FIG. 1 shows in perspective a toilet compartment provided with a wash basin and a lavatory pan, while the walk-in base tray is shown separated from the cell walling of the toilet compartment.

FIGS. 2 and 3 show two angle elements of the cell walling in perspective.

Figure 6:
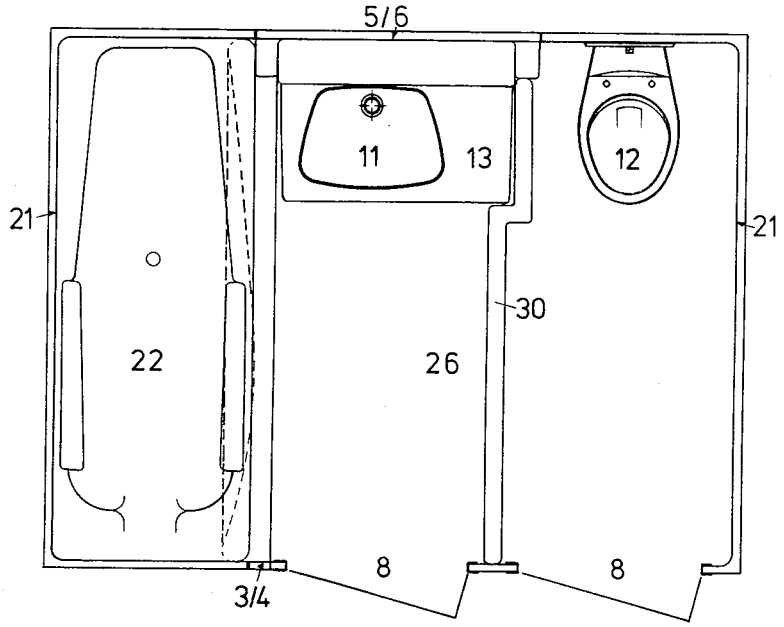

By FIG. 6 there is shown an embodiment of a walk-in base tray in plan, on one longitudinal side of which there is attached a bath tub, and on the other longitudinal side there is arranged a lavatory pan in a second compartment which is only separately accessible from outside.

Figure 7:
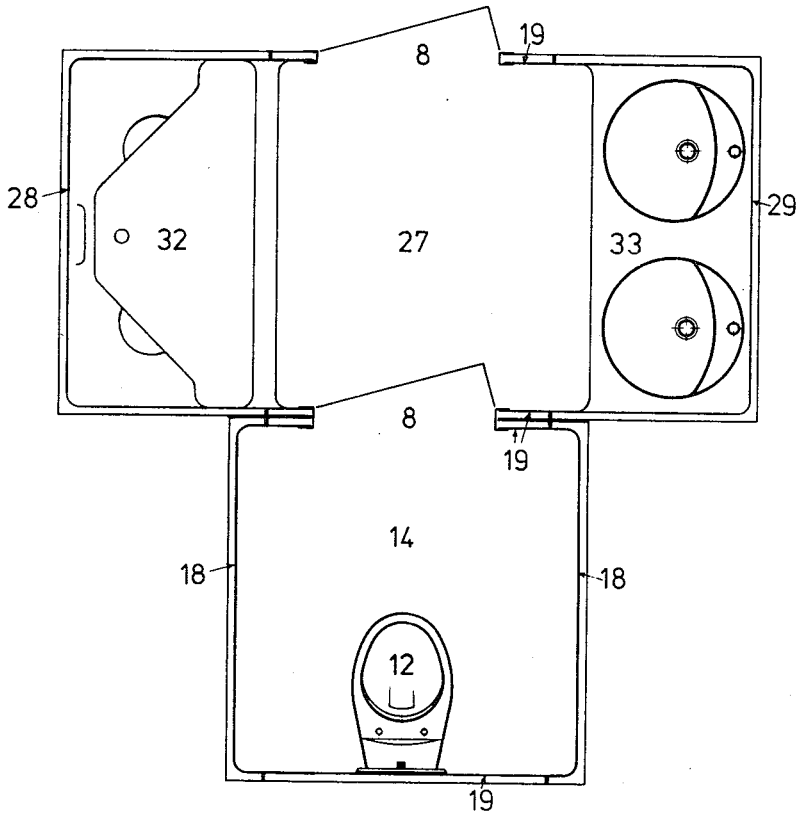
Figure 8:
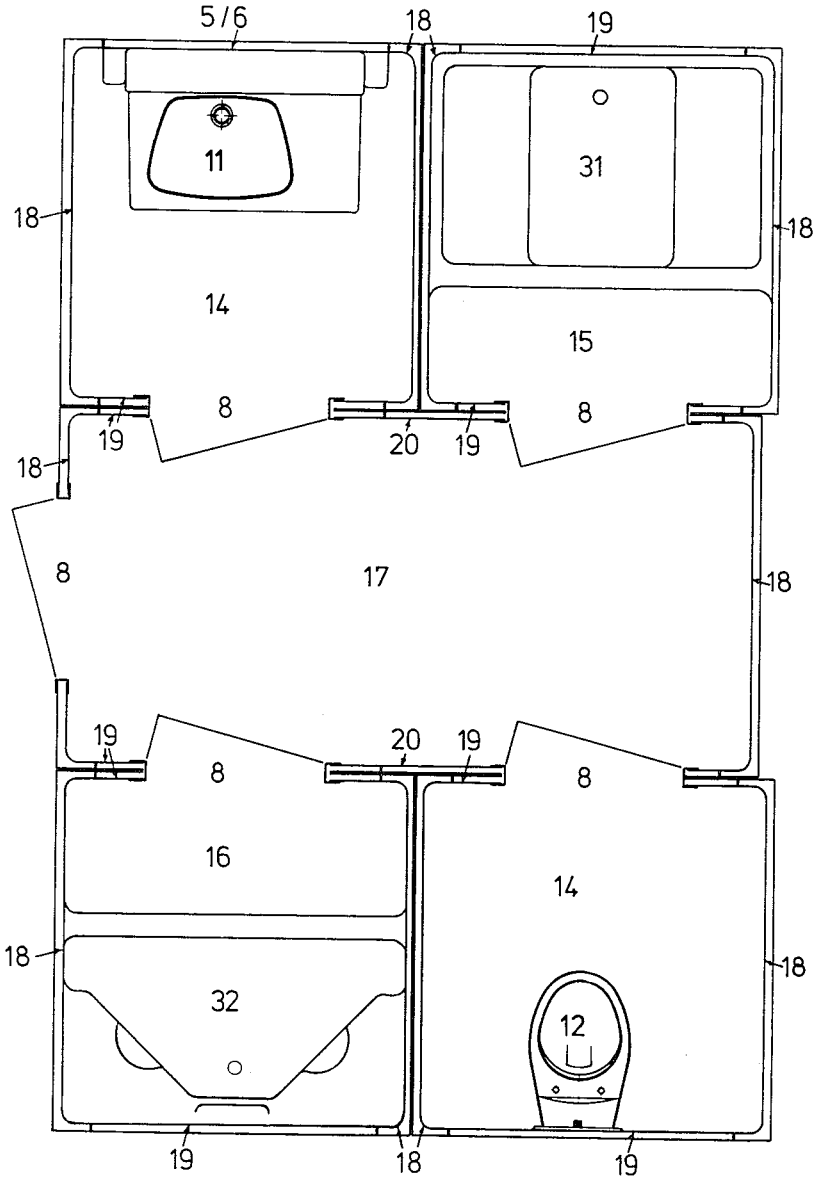

In FIGS. 7 and 8 further variations of possible toilet compartments are shown schematically, in which FIG. 7 shows two walk-in base trays united together, whereas FIG. 8 shows four toilet compartments separated from one another but only accessible through a fifth walk-in base tray, with fittings independent of one another.

DESCRIPTION OF THE PREFERRED EMBODIMENTS

The mode of construction according to the invention, founded on a modular dimensional system, has as its basis a walk-in base tray with the sides ratio of e.g. 1:1, 1:2, 1:3, or 1:1.5, 1.5:1.5, 1.5:2. The booth walling of the toilet compartment is determined in accordance with the modular dimension system by the sides ratio of the walk-in base tray. The walk-in base tray 1 possesses a flange 2*a* standing out at right angles from the upper periphery of the tray, as is shown in FIG. 1. The booth walls 3, 6 are constituted by the vertical limbs of angle elements which are formed with a right angle and which with the other limb, 4 or 5 respectively, constitute a part of the compartment ceiling. These two angle elements $\frac{3}{4}$ and 5/6 have on all their edges flanges 2*c*, 2*d*, respectively standing outwards, with which they can be connected firmly and tightly on the one hand with the flange 2*a* of the base tray 1, on the other hand with one another in the neighbourhood of the compartment ceiling. The compartment is also enclosed by two side wall panels 9 lying opposite one another, which likewise at their edges have flanges 2*d* standing outwards, and by means of these can be connected to the flange 2*a* of the base tray 1 and to the flanges 2*c*, 2*d* respectively of the individual constructional elements $\frac{3}{4}$, 5/6 respectively of the two angular elements. Before assembly, all individual components of the booth walling as well as the walk-in base tray 1 are, in accordance with their predetermined functions, provided with the necessary bores, holes or cut-outs for the installation of supply and drainage pipes, of ventilation and of lighting. Thus the wash basin is indicated at 11, the outlet of the lavatory at 12, the ventilation at 7, and the lighting at 10. A door 8, respectively in one side wall panel 9 and in the base tub 1, permits the entry into the compartment. In the booth wall 6 of the angle element 5/6 there is integrally formed a bracket 13 for reception of the wash basin.

It can be seen that the construction according to the invention of the individual components involves the great advantage of easy transport of the individual components to the place of installation, and a restricted requirement as regards tools and time for the assembly of the individual components.

According to the modular dimensional system stated above, such ablution or toilet compartments can be built in different sizes and for satisfying different functional requirements in the sanitary field, on site totally within rooms, or also in the open air, rapidly and without problem.

Figure 4:
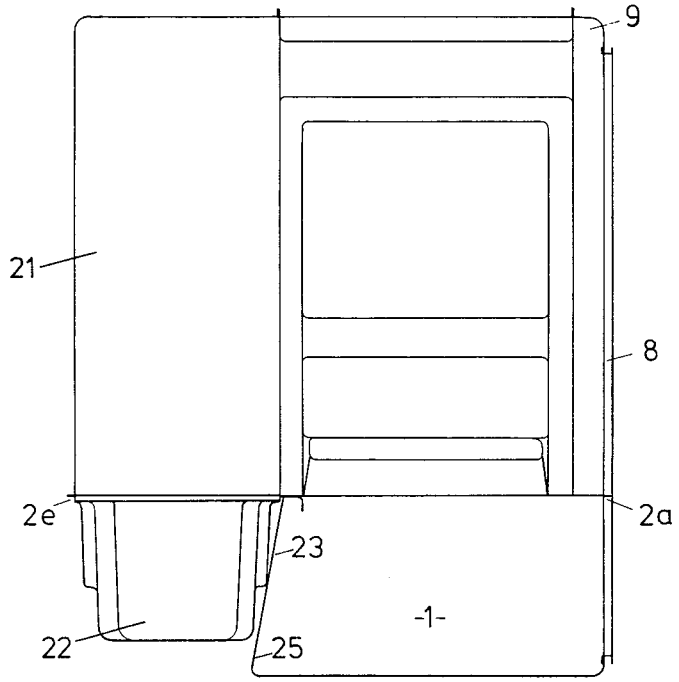
In FIGS. 4 and 5 there is shown a toilet compartment with a wash basin, a bath tub and a lavatory pan, in partial vertical section and in plan on the base tray and the bath tub.
Figure 5:
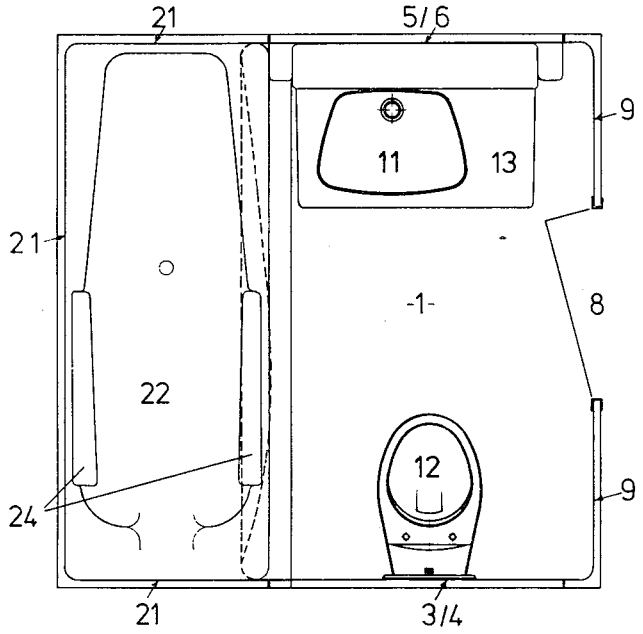

In FIGS. 4 and 5 there is shown a further embodiment of a toilet compartment which is extended in comparison with the first embodiment, in vertical section, and in a plan on the walk-in base tray 1, which in this case is combined with a bath tub 22. The base tray 1 here has the sides ratio 1:1.5, in order to do justice to the length of a complete bath tube 22. If, however, one is concerned with a sitz bath tub, then for example a walk-in base tray with a sides ratio of 1:1 can be employed. The tub wall 23, which separates the bath tub 22 from the accessible space of the base tray 1, is made elastically yielding and is rendered concave by the arm supports 24 of the bath tube 22, in the direction facing the accessible space of the base tray 1, so that it constitutes a foot recess 25 towards the lower edge of the bath tub 22. The peripheral edge 2*e* of the bath tub 22 is prolonged everywhere so far that it overlaps the upper edge of the dividing wall 23. Now in the walk-in base tray 1 a lavatory pan 12 can be provided, secured either on the narrow wall or on the longitudinal wall. In the cell wall 6 of the angular element 5/6, a wash basin 11 can be mounted on an integrally formed bracket 13. The access into the walk-in toilet space of the base tray 1 is given through a door 8 provided in the side wall panel 9. The box element 21 is, in contrast to the first embodiment, matched to the bath tub 22 in cross section, so that the total ground surface of the base tray 1 and of the bath tub 22 is totally enclosed by the individual constructional components $\frac{3}{4}$, 5/6, 21 and 9, and a walk-in toilet compartment is produced with great functional capability. Pipe connections for the fresh water supply, for the dirty water drainage, and the sewage, as well as for the ventilation and the lighting, are not considered in the drawing, but are assumed as self-evident.

In many cases endeavour is made to keep the lavatory separate from the washing and bathing space. FIG. 6 shows such an embodiment schematically in ground plan. In this case the walk-in base tray is separated by the wall 30 from the bathing space. In this lavatory space a lavatory pan 12 is arranged against the narrow side. In the wall lying opposite the lavatory pan a door 8 is provided, which ensures the separate entrance to the lavatory 12. The base tray 26 with the bath tub 28 is arranged as in the embodiment according to FIG. 5. The access to the toilet space having the bath tub 22 and the wash basin 11 takes place through its own door 8.

The advantage of the modular dimensional system already shows itself even form the three previously-explained types of construction of toilet compartment, in that for these three types of construction only 8 different building elements, e.g. 1, $\frac{3}{4}$, 5/6, 9, 21, 22, 26, 30, are necessary, but in addition these building elements can also be used in many further types of construction as desired.

Thus for example in addition to the three previously-discussed forms of construction of a toilet compartment according to the modular dimensional system, by building together or combining of base trays, groups of toilet compartments with different functional provisions can be formed which are accessible independently from one another. Thus the example shown schematically in FIG. 7 of a toilet compartment illustrates that, against the longitudinal wall of a walk-in base tray 27, which is provided with an integrally formed shower basin 32, a base tray 14 is added, which is equipped with a lavatory pan 12. The booth walls, which are built up on the base tray 27, consist of the box element 28 and the box element 29, which has an integral bracket 33 for a double wash basin, and also of two angle elements 19. The booth walls, which are built up on the base tray 14, again consist of two angle elements 19 as well as two side wall panels 18. The two separate toilet compartments are each accessible through the doors 8, while the door frame of the communicating door acts at the same time as a coupling element.

The embodiment of FIG. 8 shows by way of example a base tray 17 with a sides ratio 1:2. In the angle elements 19 and 20 of the cabin walling, there are cut out door openings 8 at spacings from one another, through which individual compartments are accessible. Each of the four individual compartments is only accessible via the toilet space constituted by the walk-in base tray 17 and its booth walling, and is dedicated to a separate functional requirement. For construction of these individual compartments, substantially the individual components which have already been used in the examples according to FIGS. 1 to 7 are again suitable. Toilet compartments formed in this way can also be installed in the open air and, for example for weekend houses or on camping sites, contribute additionally to improvement of the living conditions.

These embodiments can be extended in many variations. What is important is that, by the modular dimensional system, in the many embodiment possibilities of the ablution compartments or toilet compartments, with a minimum number of individual constructional elements, and hence with a minimum of joints between parts, success can be obtained and these individual constructional elements require a relatively small transport space and can be delivered without difficulties through every known door opening.

What is claimed is:

1. In an ablution compartment including a base tray having a periphery and a plurality of booth elements supported on said base tray, the improvement wherein said booth elements comprise a plurality of first wall elements and a plurality of second wall elements; each said first wall element being of an angled configuration having a single, substantially planar wall limb and a single, substantially planar ceiling limb arranged at right angles to the wall limb; each said second wall element having a wall surface and connecting two said first wall elements to one another; the wall limbs of said first wall elements and the wall surfaces of said second wall elements together forming an all-around enclosure above said base tray; the improvement further comprising securing means for tightly attaching said booth elements to one another and to said periphery of said base tray.

2. An ablution compartment as defined in claim 1, wherein said securing means comprises outwardly directed flanges forming part of said booth elements and said base tray; flanges of said base tray and those of adjoining booth elements being in a face-to-face relationship with one another.

3. An ablution compartment as defined in claim 1, wherein said base tray has four sides and the number of said first wall elements and said second wall elements is two each.

4. An ablution compartment as defined in claim 1, wherein at least one of said second wall elements is a side panel arranged at right angles to each wall limb and to each ceiling limb.

5. An ablution compartment as defined in claim 1, wherein at least one of said second wall elements is a box element having a plurality of vertical wall surfaces.

6. An ablution compartment as defined in claim 1, further comprising an additional compartment constituting an individual unit added laterally to said base tray; said additional compartment being accessible solely from the space enclosed by said booth elements.

7. An ablution compartment as defined in claim 6, wherein said base tray is a first base tray; further comprising a second base tray with peripheral rim constituted as a bath tub with arm rests, connected with said first base tray, whereby said rim of said bath tub seals against a separating wall at the periphery of said first base tray, and said separating wall is rendered concave by said arm rests, in the direction facing said first base tray, thereby constituting a foot recess.

* * * * *